United States Patent [19]

Villavicencio

[11] Patent Number: 4,689,117

[45] Date of Patent: Aug. 25, 1987

[54] THERMOMECHANICAL DIGESTION PROCESS FOR ENHANCING THE BRIGHTNESS OF CELLULOSE PULP USING BLEACHANTS

[75] Inventor: Eduardo J. Villavicencio, San Angel, Mexico

[73] Assignee: Process Evaluation and Development Corporation, Dallas, Tex.

[21] Appl. No.: 772,575

[22] Filed: Sep. 4, 1985

Related U.S. Application Data

[63] Continuation-in-part of Ser. No. 496,892, May 23, 1983, abandoned, which is a continuation-in-part of Ser. No. 412,060, Aug. 27, 1982, abandoned, which is a continuation-in-part of Ser. No. 210,057, Nov. 24, 1980, Pat. No. 4,347,101.

[51] Int. Cl.[4] ..... D21C 3/26

[52] U.S. Cl. ..... 162/19; 162/22; 162/25; 162/65; 162/78; 162/83; 162/94; 162/96; 162/97

[58] Field of Search ..... 162/25, 26, 21, 22, 162/19, 241, 246, 17, 18, 24, 28, 52, 96, 78, 65, 83, 94, 141, 149, 97, 84, 86

[56] References Cited

U.S. PATENT DOCUMENTS

| | | | |
|---|---|---|---|
| 1,774,403 | 8/1930 | Richter | 162/78 |
| 1,938,802 | 12/1933 | Braun et al. | 162/52 |
| 2,771,361 | 11/1956 | Birdseye et al. | 162/22 |
| 3,238,088 | 3/1966 | Villavicencio et al. | 162/96 |
| 3,354,030 | 11/1967 | Williams et al. | 162/22 |
| 3,446,699 | 5/1969 | Asplund et al. | 162/26 |
| 4,248,662 | 2/1981 | Wallick | 162/19 |
| 4,260,452 | 4/1981 | Kruger et al. | 162/25 |
| 4,295,925 | 10/1981 | Bentvelzen et al. | 162/22 |
| 4,347,101 | 8/1982 | Villavicencio | 162/25 |

OTHER PUBLICATIONS

Pulping Processes; S. A. Rydholm Interscience Publishers; New York.

*Primary Examiner*—Steve Alvo

*Attorney, Agent, or Firm*—Michael J. McGreal

[57] ABSTRACT

The brightness of a thermomechanical pulp can be improved if a serial multiple blowdown technique is used and a bleachant is present at an effective concentration throughout the thermomechanical pulping process.

8 Claims, 1 Drawing Figure

Figure 1:
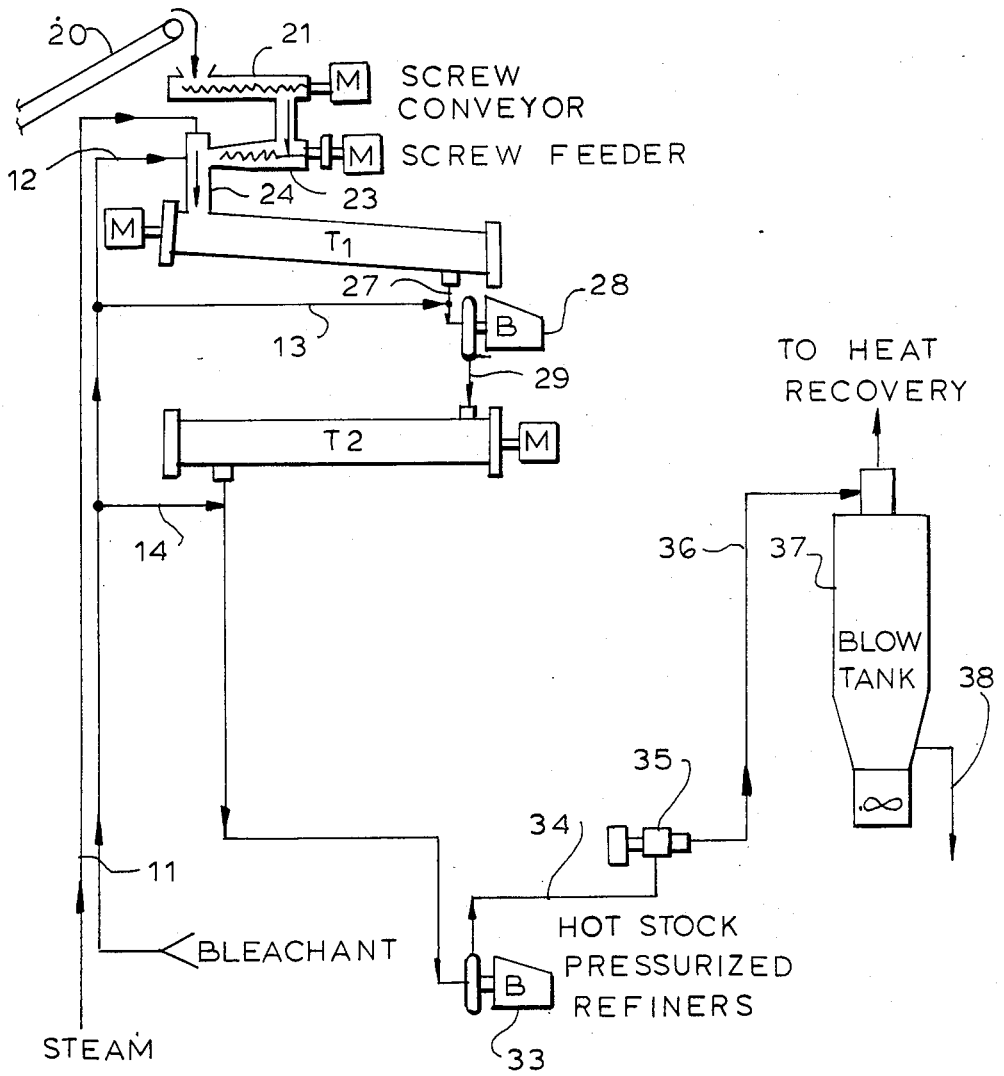

THERMOMECHANICAL DIGESTION PROCESS FOR ENHANCING THE BRIGHTNESS OF CELLULOSE PULP USING BLEACHANTS

This application is a continuation-in-part of U.S. Ser. No. 496,892, filed May 23, 1983, now abandoned; which is, in turn, a continuation-in-part of U.S. Ser. No. 412,060, filed Aug. 27, 1982, now abandoned; which is again, in turn, a continuation-in-part of U.S. Ser. No. 210,057, filed Nov. 24, 1980, now U.S. Pat. No. 4,347,101.

This invention relates to an improved method for producing a thermomechanical pulp having an improved brightness. A G.E. brightness of 55° C. can be achieved with a thermomechanical pulp through the use of a multiple blowdown technique combined with bleachant being present throughout the digestion.

There is a problem in thermomechanical digestion that at temperatures above about 150° C., which translates to an autogenous steam pressure of about 3.8 kg/cm$^2$ gage, the lignin and other non-cellulosic substances rapidly discolor the pulp. This is equivalent to a pressure of about 54 psig. Whereas a higher temperature would increase the removal of lignin, this is counterproductive due to the discoloration of the pulp. For instance, a bagasse which initially has a G.E. brightness of about 40 to 45 will have a G.E. brightness as a pulp of 20 to 25 if processed at about 160° C. This can be increased to about 40 to 50 G.E. brightness with strong bleaching after pulping. However, no matter how strong the bleaching, a bagasse thermomechanical pulp will never attain a G.E. brightness above 50. As used in this specification, a thermomechanical pulp is one produced using steam and a mechanical working of the pulp.

It is generally preferred to use thermomechanical digestion processes rather than semichemical processes. However, it is a usual requirement that the pulp have a high G.E. brightness. Consequently, thermomechanical bagasse pulping processes have usually been conducted below about 140° C. However, it has been found that this problem can be obviated if a multiple blowdown theremomechanical digestion process is used and a bleachant is present throughout the thermomechanical digestion. The bleachant should be added with the initial fiber input and just prior to each blowdown. In this way there will be an effective amount of bleachant present throughout the thermomechanical pulping process.

If bleach is added only at the initial fiber input stage, it is gradually dissipated to the point that at the latter part of the digestion sequence there is little or no bleaching action. Also, since the initial bleach concentration is high there will be fiber attack resulting in a weaker paper product.

An advantage to having the bleach present throughout digestion is to have the bleach oxidize any color bodies (discoloring digestion products) as they are formed to non-colored substances. This is more effective than forming the color bodies and then in a subsequent step using a strong bleach concentration to oxidatively remove the discoloring materials. This substantially decreases the time that any discoloring materials are in contact with fibers, and consequently decreases the amount of discoloring material that is absorbed by the fibers.

In the present process, bleach is added along with fiber to the first digester with additional bleach added just prior to a rapid pressure reduction. Rapid pressure reduction takes place between each stage of digestion and just prior to blowdown to atmospheric pressure. The reason is that when added prior to a depressurization the bleach can be added in a greater volume, although at a lower concentration. This permits a more even wetting and contact with the fiber surfaces, with the subsequent rapid pressure reduction serving to automatically increase the concentration of the bleach on the fibers. The bleach concentration increases since on reducing the pressure a part of the water of dilution of the bleach is given off as steam. This results in having a high bleach level concentration on the fibers at the input end of each digester.

Although various-known pulp bleachants can be used, the preferred bleachant is hydrogen peroxide. It has generally been thought that above about 100° C. hydrogen peroxide would decompose so rapidly that it would not be available as a bleach throughout a stage of the digestion. This would then lead to the same problem of pulp darkening which is characteristic of a bagasse pulp. However, it has been found that in the present processing the hydrogen peroxide does not decompose so rapidly that it is not available throughout a full stage of pulp digestion. In fact, the rate of decomposition is such that with addition at each stage before depressurization it provides for effective bleaching through the digestion.

A process related to that disclosed in this specification is described in U.S. Pat. No. 4,437,101. However, in the process set forth in that patent no bleach is added during digestion. It is also necessary to keep the thermomechanical pulping temperature below about 150° C. The reason is pulp discoloration. Also, in that process it is necessary to subject the pulp to strong post-digestion bleaching and to mix the bleached pulp with a semichemical pulp in order to achieve a high brightness. A prime advantage of the present improvement is that in a process such as set forth in U.S. Pat. No. 4,347,101 only a small quantity, if any, semichemical pulp need be added to get the same brightness. This has the result of being able to produce stronger paper products since stronger papers can be produced from a thermomechanical pulp than from a semichemical pulp. Also, semichemical pulps are more expensive to produce due to the cost of the chemicals, chemical recovery and pollution controls and pulp loss during the harsher digestion.

In brief summary, the present process consists of subjecting a fiber source, which can be a wood or a vegetable fiber source, but which is preferably bagasse, bamboo and related fibers to an autogenous steam pressure of about 2 to 15 kg/cm in the presence of a bleachant, reducing the pressure at least about 0.5 kg/cm$^2$ in one or more stepwise depressurizations, and adding bleachant just prior to one or more of the stepwise depressurizations. The high pressure steam atmosphere and stepwise depressurizations remove the lignin and other noncellulosic materials, and the presence of the bleachant prevents the discoloration of the pulp.

The Figure is a schematic drawing of the present digestion process.

In more detail the present process can be operated on a batch or on a continous basis. However, it is preferred to operate it on a continuous basis. If operated as a batch process, a pressurized reactor can be used. Stepwise depressurization would be carried out by releasing the pressure through the valve on the top of the digester after the addition of a bleach solution. When operated as a continuous process, it is preferred to use a multiple number of tubular chamber digesters, each containing a screw to move the pulp from one end to the other. In between each of the tubular digesters, is a pressure-reducing means such as a blowdown valve or a disc refiner. A disc refiner can be operated to function as a blowdown valve. The pressure is rapidly reduced at least about 0.5 kg/cm$^2$, and preferably about 1 kg/cm$^2$ at each depressurization. Also, prior to each depressurization there is valve means for adding a bleach solution to the pulp. Although there can be from two to ten tubular chambers, it is preferred to use two or three tubular chambers. The preferred bleachant is hydrogen peroxide, although other bleachants such as sodium preoxide, oxygen, ozone, zinc hypsulfite and sodium hyposulfite can be used. Mixtures can also be used. Hydrogen peroxide is an easy to handle bleachant, and it has been found to have a sufficiently slow decomposition rate at the process temperatures and pressures. Hydrogen peroxide starts to decompose at about 100° C., but does not decompose rapidly until a temperature of about 170° C. is reached. This rather slow decomposition rate insures that the bleachant will be present throughout the digestion in each tubular digester.

The total amount of bleach added ranges from about 1·5 weight percent available oxygen calculated for the fiber content on a bone dry basis. Preferably about 3 weight percent of available oxygen is used. By available oxygen is meant the oxygen available for bleaching. For instance, hydrogen peroxide has 1 mole of available oxygen per mole of hydrogen peroxide. The bleachant is added as a 1 to 5 weight percent aqueous solution. The amount of solution added will depend on the available oxygen needed for bleaching and the dilution of the bleachant. Buffering agents such as sodium hydroxide, potassium hydroxide or other strong base can also be added. It is preferred that the fiber mass be maintained at a ph of greater than about 10 during digestion since both digestion and bleaching is more effective at a basic ph. Sodium silicate is usually added with hydrogen peroxide bleaches to promote the formation of the free oxygen. Magnesium sulfate is added to stabilize hydrogen peroxide at higher temperatures.

The process will now be more particularly described with reference to the Figure. In the Figure the feed cellulosic fiber material, which can be shredded wood, bamboo, euclyptus or a vegetable such as bagasse, corn stalks or straw, is fed from conveyor 20 into screw conveyor 21. The fiber flows from screw conveyor 21 to screw feeder 23, and then into tubular chamber T1 through conduit 24. Steam and up to about two-thirds of the bleach solution are added to the cellulosic fiber at this point. The fiber is conveyed from the entrance end of tubular chamber T1 by a screw driven by motor M. The residence time of the fiber in T1 can range from 1 to 20 minutes or more. However, it has been found that a residence time of 2 to 10 minutes is sufficient for fiber processing and provides for a reasonable throughput. The fiber exits T1 at 27. Up to about two-thirds of the remaining bleachant is added to the fiber at this point through line 13. The fiber then undergoes a depressurization (pressure drop) of about 1 kg/cm$^2$ at blowdown valve 28. A refiner can be used as a blowdown valve with the added benefit of getting some working of the fiber. The fiber now at a reduced pressure flows through line 29 and into tubular chamber T2. Tubular chamber T2 can have the same volume as tubular chamber T1 or a differing volume. The volume of T1 and T2 will, to a large degree, determine the residence time of the fiber in each tubular chamber. It is preferred to have an increased residence time of from about 1 to 20 minutes in the second tubular chamber. In the Figure the tubular chambers are shown as having the same volume; however, this need not be the case.

The fiber is conveyed through T2 by means of a screw driven by motor M. Since the volume of T2 is the same as T1, the fiber residence time in T2 will be about the same or can be slightly longer than the residence time in T1. The residence time can be slightly longer than in tubular chamber T1 since the fiber solids content decreases during processing in T1. This decrease in solids content will permit some adjustment of the screw conveyor in tubular chamber T2 to produce a longer residence time in T2. The fiber exits tubular chamber T2 at 31. Any remaining bleachant is added via line 14 and the digested fibers proceed to hot stock pressurized refiners at 33 or in the alternative some other processing. After hot stock pressured refining which is a preferred embodiment, the pressure is decreased to atmospheric pressure at 35 with fiber and heat recovery in blow tank 37. The fiber enters the blow tank through line 36 and exits via line 38. The fiber can now be washed and used, or subjected to further processing.

Although the process has been described using a two-tubular chamber digester, a three or more tubular chamber digester with depressurization between each tubular chamber can be used. However, the benefits of using more than three tubular chambers are usually less than the increased capital cost of equipment.

The following procedure describes one method of practicing the present process with particular reference to the Figure.

Procedure For Continuous Process

A two-stage tubular chamber digester wherein each tubular chamber has a length of 10 meters and a diameter of of 1.5 meters is operated with a depressurization from the first tubular chamber T1 to the second tubular chamber T2 of 1.2 kg/cm$^2$. The pressure in T1 is 3.0 kg/cm$^2$. Steam is added at the rate of 130 kg/min with hot water being added at the rate of 300 kg/min. Bagasse having a moisture content of 60 wt. percent is added at the rate of 325 kg/min. An aqueous solution of hydrogen peroxide containing 30 grams per liter of hydrogen peroxide, 30 grams per liter of sodium hydroxide and 30 grams per liter of magnesium sulfate is added to T1 at the rate of 26 kg/min. The screw in T1 is operated to give a residence time of 3 minutes. The temperature in T1 is normally 145° C. The fiber then exits T1 and undergoes a depressurization of 1.2 kg/cm$^2$ in a conventional blowdown valve. Just prior to blowdown, an additional 9.5 kg/min of the aqueous hydrogen peroxide solution is added. The fiber, steam and water then flows into T2. The rate of flow is about 130 kg/min of solids, 60 kg/min of steam and about 600 kg/min of water. The residence time in T2 is 5 minutes. The fiber exits T2 and the remaining bleach is added (4.5 kg/min). The fiber then undergoes hot stock refining and blowdown. The fiber and solids are separated from the steam and hot water at about 100° C. in the blow tank. The steam and hot water are recycled for use in the process. The fiber goes to washing and other processing.

Various modifications can be made to this process. However, in order to gain the full benefits of the process there should be blowdown between stages of digestion, bleach must be present throughout digestion, and preferably bleach should be added prior to each blowdown. Consequently, any modifications would be within the present invention.

As used in this specification, the term autogenous pressure means the pressure of steam at a given temperature.

I claim:

1. An improved method for enhancing the brightness of a cellulose fiber pulp undergoing digestion in a thermomechanical process comprising the steps of:

(a) providing a fiber source in a form suitable for input into a digester;

(b) conveying the fiber source into a first chamber of a digester and contacting said fiber source with steam and a first quantity of a bleach solution at an autogenous pressure of 2 kg/cm to 15 kg/cm for a first period of time;

(c) removing said fiber source from said first chamber, and rapidly decreasing the pressure on said fiber source at least 0.5 kg/cm to a first lower pressure; wherein water within said cellulose fiber source flashes to steam opening the fibers; and (d) inputing said fiber source at said first lower pressure into a second chamber of said digester for contact, with steam at said first lower pressure for a second period of time;

the improvement comprising adding a second quantity of a bleach solution to said fiber source after removing said fiber source from said first chamber and prior to rapidly reducing the pressure on said fiber source to said first lower pressure, wherein part of the water of dilution of said second quantity of bleach solution converts to steam thereby concentrating said second quantity of bleach solution on said fiber source.

2. A method for improving the brightness of cellulose fibers undergoing thermomechanical digestion as in claim 1 wherein the pressure on said fiber source at said first lower pressure is further decreased to atmospheric pressure.

3. A method of improving the brightness of cellulose fibers undergoing thermomechanical digestion as in claim 1 wherein said fiber source is selected from the group consisting of wood, bamboo, bagasse, straw and eucylyptus.

4. A method for improving the brightness of cellulose fibers undergoing thermomechanical digestion as in claim 3 wherein said bleachant is selected from the group consisting of hydrogen peroxide, sodium peroxide, oxygen, ozone, sodium hydrosulfite and zinc hydrosulfite.

5. A method for improving the brightness of cellulose fibers undergoing thermomechanical digestion as in claim 4 wherein the bleach solution contains a buffering agent selected from the group consisting a sodium hydroxide and potassium hydroxide.

6. A method for improving the brightness of cellulose fibers undergoing thermomechanical digestion as in claim 1 wherein the autogenous pressure of steam in contacting said fiber source is about 2.5 $kg/cm^2$ to 10 $kg/cm^2$.

7. A method for improving the brightness of cellulose fibers undergoing thermomechanical pulp as in claim 6 wherein said autogenous pressure is decreased at least 1 $kg/cm^2$ to the first lower pressure and at least 1 $kg/cm^2$ to the first lower pressure.

8. A method as in claim 7 for improving the brightness of a thermomechanical pulp wherein said bleach is slected from the group consisting of hydrogen peroxide, sodium peroxide, oxygen, ozone, sodium hydrosulfite and zinc hydrosulfite.

* * * * *